US008066562B1

(12) United States Patent
Thompson et al.

(10) Patent No.: US 8,066,562 B1
(45) Date of Patent: Nov. 29, 2011

(54) METHOD OF SIMULATING A TRADITIONAL ROULETTE GAME EXPERIENCE

(75) Inventors: Glenn Thompson, Tulsa, OK (US); Steven Bilby, Sapulpa, OK (US); Steven Loyd, Laquinta, CA (US); Duane D. Jennings, Tulsa, OK (US)

(73) Assignee: Cherokee Nation Enterprises, LLC, Catoosa, OK (US)

( * ) Notice: Subject to any disclaimer, the term of this patent is extended or adjusted under 35 U.S.C. 154(b) by 872 days.

(21) Appl. No.: 12/034,767

(22) Filed: Feb. 21, 2008
(Under 37 CFR 1.47)

Related U.S. Application Data

(60) Provisional application No. 60/902,438, filed on Feb. 21, 2007.

(51) Int. Cl.
*A63F 9/24* (2006.01)

(52) U.S. Cl. ..... 463/17; 463/18; 463/21

(58) Field of Classification Search ..... 436/17; 463/18, 21

See application file for complete search history.

(56) References Cited

U.S. PATENT DOCUMENTS

| | | | | |
|---|---|---|---|---|
| 5,669,816 | A * | 9/1997 | Garczynski et al. | 463/12 |
| 6,403,908 | B2 * | 6/2002 | Stardust et al. | 209/587 |
| 6,913,262 | B2 * | 7/2005 | Berman | 273/292 |
| 7,128,645 | B1 * | 10/2006 | White et al. | 463/13 |
| 2009/0115133 | A1 * | 5/2009 | Kelly et al. | 273/274 |

* cited by examiner

*Primary Examiner* — Pierre E Elisca
(74) *Attorney, Agent, or Firm* — Molly D. McKay

(57) ABSTRACT

A method of simulating a traditional casino roulette game experience using a specially designed deck of thirty eight (38) playing cards to determine a winning number rather than via a spin of the roulette wheel. The deck includes one card for each single unique number from the roulette wheel, i.e. 00, 0, and numbers 1-36. The deck is shuffled so that the cards are drawn at random to simulate a spin of the roulette wheel. The dealer activates the shuffler to draw a card from the shuffled deck. A bar code on the drawn card is read into a computer via a scanner. Scanning the card activates the computer to provide a visual representation of a spin of the roulette wheel on a monitor located near the roulette table. The visualization shows the ball landing on the unique number of the roulette wheel dictated by the drawn card.

16 Claims, 2 Drawing Sheets

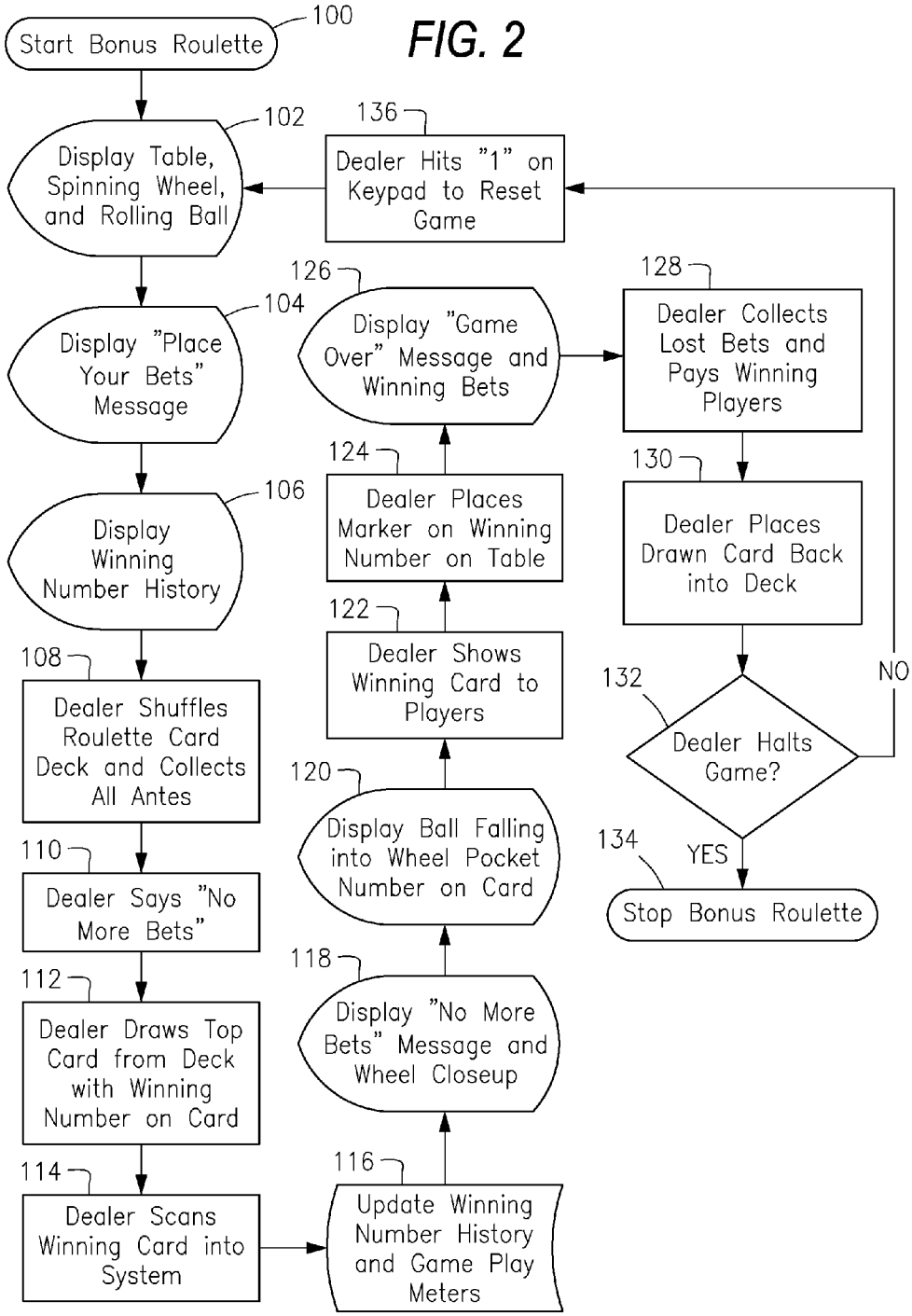
FIG. 2
100
Start Bonus Roulette
102
Display Table, Spinning Wheel, and Rolling Ball
104
Display "Place Your Bets" Message
106
Display Winning Number History
108
Dealer Shuffles Roulette Card Deck and Collects All Antes
110
Dealer Says "No More Bets"
112
Dealer Draws Top Card from Deck with Winning Number on Card
114
Dealer Scans Winning Card into System
116
Update Winning Number History and Game Play Meters
118
Display "No More Bets" Message and Wheel Closeup
120
Display Ball Falling into Wheel Pocket Number on Card
122
Dealer Shows Winning Card to Players
124
Dealer Places Marker on Winning Number on Table
126
Display "Game Over" Message and Winning Bets
128
Dealer Collects Lost Bets and Pays Winning Players
130
Dealer Places Drawn Card Back into Deck
132
Dealer Halts Game?
NO
YES
134
Stop Bonus Roulette
136
Dealer Hits "1" on Keypad to Reset Game

METHOD OF SIMULATING A TRADITIONAL ROULETTE GAME EXPERIENCE

CROSS-REFERENCE TO RELATED APPLICATIONS

The present invention claims priority to U.S. Provisional Patent Application No. 60902438 filed on Feb. 21, 2007 for Method of Simulating a Traditional Roulette Game Experience.

BACKGROUND OF THE INVENTION

1. Field of the Invention

The present invention relates to a method of simulating a traditional casino roulette game experience using a specially designed deck of thirty eight (38) playing cards to determine a winning number rather than via a spin of the roulette wheel. The invention employs a standard roulette table, a flat panel LCD or plasma monitor provided near the roulette table so that it is visible by the players, a card shuffler, a keypad, a bar code scanner attached to a dedicated computer and the specially designed deck of thirty eight (38) cards. The deck includes one card for each single unique number from the roulette wheel, i.e. 00, 0, and numbers 1-36. Each card has a barcode containing information about the unique number appearing on the card and information on the color associated with that unique number on the roulette wheel.

The deck is shuffled so that cards are drawn at random to simulate a spin of the roulette wheel. The dealer activates the shuffler to draw a card from the shuffled deck. A bar code on the drawn card is read by a bar code scanner which feeds information into a computer about the number and its associated color which appear on the card. Scanning the card activates the computer to provide a visual representation of a spin of the roulette wheel on a monitor located near the roulette table. The barcode on the card controls the visualization to show the ball landing on the unique number and color of the number of the roulette wheel dictated by the drawn card.

2. Description of the Related Art

The traditional game of roulette is played on a purpose-built table and a roulette wheel with a ball is used. Players place their bets by placing one or more of their uniquely colored chips on the table so as to define the bet that they are placing. Various types of bets are possible. A bet is a prediction by the player of where the ball will land after each spin of the roulette wheel. To win at roulette, a player needs to accurately predict where the ball will land, i.e. the number or color of the pocket where the ball will come to rest. The complete rules for the game of roulette, including the types of bets possible, can be found on various websites by searching for "roulette game rules". One of many such websites is ildado.com and another is fastodds.com. These traditional rules for the game of roulette are hereby included by reference.

To play the traditional game of roulette, the players first bet and then the dealer spins the roulette wheel. The ball eventually lands in one of the numbered pockets provided at the perimeter of the roulette wheel. The wheel has 38 numbers, i.e. 00, 0, and numbers 1-36, and each number is associated with a color, i.e. red, black or green. The number of the pocket in which the ball comes to rest dictates the winning number for the game and thus dictates which players win and which players lose. The dealer collects the losing bets and pays out on the winning bets.

Gaming regulations sometimes restrict casinos to only games that employ cards and do not allow the casinos to use games that employ roulette wheel and balls. However, casinos that are thus restricted still would like to be able to provide a roulette game experience to their customers. The present invention allows casinos to provide such an experience within their gaming restrictions. Specifically, the present invention substitutes a special deck of cards for the roulette wheel and ball that are employed in a traditional roulette game.

SUMMARY OF THE INVENTION

The present invention provides casino guests with an authentic roulette like gaming experience using a standard roulette table, a flat panel LCD or plasma monitor provided near the roulette table so that it visible to the players, a card shuffler, a specially designed deck of thirty eight (38) cards, a keypad, a bar code scanner and a dedicated computer located under the roulette table that is functionally connected to the monitor, scanner and keypad. The specially designed deck of thirty eight (38) playing cards is used to determine a winning number and color rather than via a spin of the roulette wheel. The deck includes one card for each single unique number from the roulette wheel, i.e. 00, 0, and numbers 1-36. Each card has a barcode containing information about the unique number appearing on the card and information on the color associated with that unique number on the roulette wheel.

The present method simulates a traditional roulette game by using the specially designed deck of thirty eight (38) playing cards to determine a winning number and color rather than via a spin of a roulette wheel. The specially designed deck of thirty eight (38) playing cards includes one card for each possible roll combination of a pair of dice. Each playing card of the deck has a unique number and associated color and a barcode containing information about the unique number and color appearing on the card. The barcode on the cards is used to control the matching roulette spin displayed on the monitor when the dealer activates the display by drawing a card from the deck and scanning the card's information into a computer. The computer and monitor display a roulette wheel and a 3 dimensional animated spin of the roulette wheel including the ball and roulette wheel. The barcode contains computer readable information that allows a computer to receive information via a bar code scanner about the spin number and color appearing on the card.

The playing cards are first shuffled so that the cards are drawn at random to simulate a spin of the roulette wheel in a traditional roulette game. The dealer causes a random card to be selected and ejected from the shuffler by pressing a button on the shuffler. The dealer will take the ejected card and pass it over a bar code scanner which scans the bar code on the card and transmits the information to a computer located under the roulette table about the number and color combination appearing on the ejected card, and places the card face down on the table. Scanning the card activates the display. The computer creates the display on the monitor. The display is a visual representation of the roulette ball coming to rest in the number and color pocket dictated by the drawn card.

All other aspects of the roulette game played according to the present method are the same as when playing a traditional roulette game using a roulette wheel and ball including betting, the roulette table layout, etc. Like in a traditional roulette game, the dealer controls all aspects of the game except the betting which is done by the players. The dealer controls the card draw, collecting lost bets, paying out on winning bets and managing the table bank. The only modification to the roulette game made by the present invention is that the spinning of the roulette wheel is replaced with the random drawing of a card from the specially designed playing card deck and the computer generated visualization of a spin of a roulette wheel which is controlled by the drawn playing card.

BRIEF DESCRIPTION OF THE DRAWINGS

FIG. 2 is flow chart showing a method of simulating a traditional roulette game experience according to a preferred embodiment of the present invention.

DETAILED DESCRIPTION OF THE PREFERRED EMBODIMENT

Figure 1:
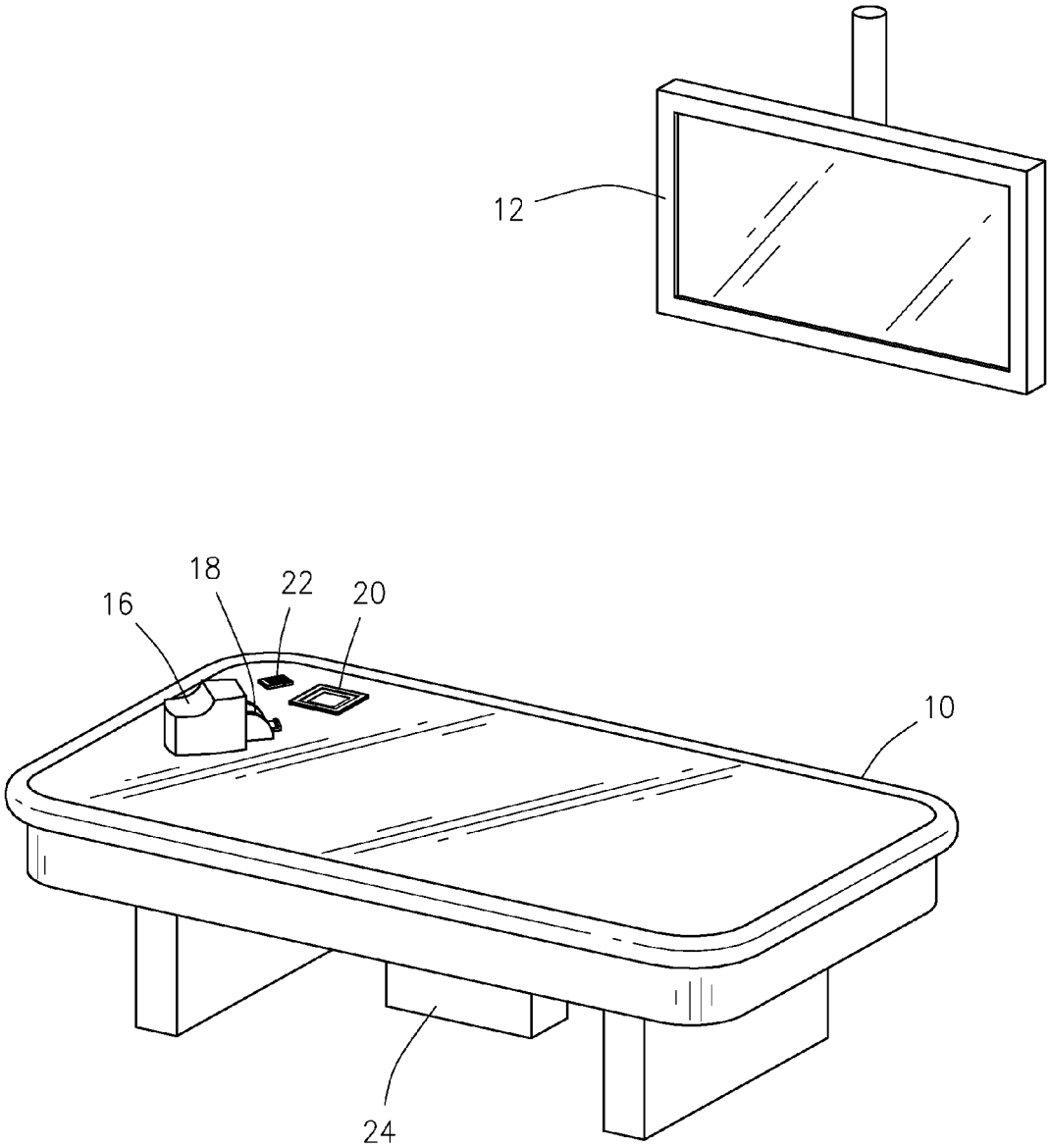
FIG. 1 is perspective view of equipment employed in the present method of simulating a traditional roulette game experience including a roulette table to which a shuffler, a bar code scanner, a keypad and a dedicated computer have been added and with a monitor located nearby.

Referring now to the drawings and initially to FIG. 1, there is illustrated equipment used by the present invention. The present invention is a method that provides casino guests with an authentic roulette like gaming experience using a standard roulette table 10, flat panel LCD or plasma monitor 12 provided near the roulette table 10 so that players can see the display of the monitor 12, a card shuffler 16, a specially designed deck of thirty eight (38) cards 18 (only one drawn card 18 of the deck is illustrated in FIG. 1), a bar code scanner 20, a keypad 22 and a dedicated computer 24 located under the roulette table 10 that is functionally connected to the monitor 12, scanner 20 and keypad 22.

The present method simulates a traditional roulette game by using the specially designed deck of thirty eight (38) playing cards 18 to determine play rather than spinning a roulette wheel. The specially designed deck of thirty eight (38) playing cards 18 includes one card 18 for each unique number and associated color of that number appearing on a traditional roulette wheel. Each playing card 18 of the deck has a unique combination of numbers and associated color from the roulette wheel and a barcode containing information about the unique number and color appearing on the card. The cards 18 are randomly shuffled by the shuffler 16 and a card 18 is drawn and scanned via a barcode scanner 20. The barcode information is provided to the computer 24 by the scanner 20 and is then used by the computer 24 to control the matching roulette wheel spin displayed on the monitor 12. Via the monitor 12, the computer 24 displays an image of a roulette wheel and three dimensional animated ball rolling into the pocket number and color of the roulette wheel dictated by the scanned card.

Referring now to FIG. 2, the start of the roulette game is shown by box 100. At the beginning of play the dealer will press the "1" key on the keypad 22. This tells the computer 24 to initially display on the monitor 12 a picture of a roulette table, a spinning roulette wheel and a rolling ball and then to display a "Place Your Bets" message, as shown in boxes 102 and 104. This also tells the computer 24 to display the winning number history, as shown in box 106. At this point the players will place their bets on the roulette table 10 in the same manner as done in a traditional roulette game.

Then as shown in box 108, the dealer then uses the shuffler to randomly shuffle the deck of cards 18 and collects the antes from the players. Collection of the antes is how the house is paid.

As shown in boxes 110 and 112, the dealer then says "No More Bets" and then draws a top card 18 from the previously randomly shuffled deck by having the shuffler to eject the top card 18 face down. This card 18 has the winning number and associated color printed on it and also includes a bar code that contains scannable information about the number and color.

As shown in box 114, the dealer then passes the drawn card 18 face down over the upwardly facing bar code scanner 20 to scan the card's bar code information into the computer 24 and dealer places the card 18 face down on the roulette table 10. Meanwhile, as indicated by box 116, the computer 24 updates the winning number history and game play meters. As shown by box 118, the computer 24 then displays on the monitor 12 the "No More Bets" message and shows a close up view of the spinning roulette wheel image. Next, as shown in box 120, the computer displays on the monitor 12 a three dimensional image of a ball rolling around on the spinning roulette wheel image landing on the pocket number and associated color dictated by the drawn card 18 using the information that was scanned into the computer 24 by the previously drawn card 18.

As a safeguard, as illustrated in box 122, the dealer then turns the drawn card 18 over so that it is then face up to show the winning number and color appearing on the card 18 to the players. The dealer then places the marker on the winning number on the roulette table 10, as shown in box 124. In the event that the pocket number and color indicia appearing on the card 18 does not match the image displayed by the computer 24 on the monitor 12, then the number and color indicia appearing on the drawn card 18 will always prevail. As shown in box 126, the computer then displays "Game Over" message on the monitor 12 along with the winning bets.

Next, as shown in box 128, the dealer collects lost bets and pays winning players. As shown in boxes 130 and 131, the dealer places the drawn card back into the deck 18 and then decides whether to halt the game. If the game is to be halted, the game ends at box 134. Alternately, if the game is not to end, the dealer hits "1" on the keypad 22 which resets the game and reset the display on the monitor 12 as it appeared at the beginning of the game, as indicated by box 102, and the game is played again as previously described above. A new deck of cards may be placed in the shuffler at this time, if desired.

All other aspects of the roulette game played according to the present method are the same as when playing a traditional roulette game using a roulette wheel and ball including betting, the roulette table layout, etc. Like in a traditional roulette game, the dealer controls all aspects of the game except the betting which is done by the players. The dealer controls the card draw, collecting lost bets, paying out on winning bets and managing the table bank.

The only modification to the traditional roulette game made by the present invention is that the spin of the roulette wheel is replaced with the random drawing of a card 18 from the specially designed playing card deck and the computer generated visualization of the spin of the roulette wheel which is controlled by the previously drawn playing card 18. That visualization of the spin appears on the monitor 12 upon activation of the computer 24 by the scanning of the drawn card 18 by the dealer, but the displayed visualization is completely controlled by the bar code information appearing on the previously drawn card 18.

While the invention has been described with a certain degree of particularity, it is manifest that many changes may be made in the details of construction and the arrangement of components without departing from the spirit and scope of this disclosure. It is understood that the invention is not limited to the embodiments set forth herein for the purposes of exemplification, but is to be limited only by the scope of the attached claim or claims, including the full range of equivalency to which each element thereof is entitled.

What is claimed is:

1. A method of simulating a traditional roulette game experience using a specially designed deck of playing cards to determine play rather than spinning a roulette wheel comprising the following steps:

a. drawing a card from a special deck of thirty eight cards wherein each of the cards in the deck contains a unique number and associated color combination of possible numbered pockets that appear on a traditional roulette wheel, b. using a computer to scan the number and color combination appearing on the randomly drawn card by scanning a bar code appearing on the drawn card into a computer wherein said bar code contains non transitory computer readable information corresponding to the number and color combination contained on the drawn card, and having the computer use the scanned information to substitute for a spin of a roulette wheel in a traditional roulette game by using the computer to display on at least one monitor a visual representation of the number and color combination contained on the drawn card.

2. A method according to claim 1 wherein the visual representation of the number and color combination contained on the drawn card that appears on said at least one monitor is an animated three dimensional image of a roulette table and a ball landing in a pocket with the number and color combination contained on the drawn card.

3. A method according to claim 1 further comprising:

c. using said at least one monitor to display directions to players prior to step a.

4. A method according to claim 3 wherein the directions displayed on said at least one monitor are to "Place Your Bets".

5. A method according to claim 4 further comprising:

d. using said at least one monitor to display directions to players after step b.

6. A method according to claim 5 wherein the directions displayed on said at least one monitor are "No More Bets".

7. A method according to claim 6 further comprising the following step that occurs after step d:

e. using said at least one monitor to display a message to players.

8. A method according to claim 7 wherein the message displayed on said at least one monitor is "Game Over".

9. A method according to claim 6 further comprising the following step that occurs after step d:

f. replacing the drawn card in the deck of cards.

10. A method according to claim 3 further comprising the following step that occurs after step c:

g. displaying winning number history on said at least one monitor.

11. A method according to claim 10 further comprising the following step that occurs after step b:

h. updating winning number history in computer.

12. A method of simulating a traditional roulette game experience using a specially designed deck of playing cards to determine play rather than spinning a roulette wheel comprising the following steps:

a. pushing a key on a keyboard attached to a computer to cause the computer to display directions on at least one monitor to "Place Your Bets", b. randomly shuffling a special deck of thirty eight cards wherein each of the cards in the deck contains a unique number and color combination of possible pocket numbers and colors appearing on a traditional roulette wheel, c. drawing a card from the previously randomly shuffled special deck of thirty eight cards, d. using the number and color combination appearing on the randomly drawn card to substitute for a spin of a roulette wheel in a traditional roulette game by scanning a bar code appearing on the drawn card into a computer wherein said bar code contains non transitory computer readable information corresponding to the number and color combination contained on the drawn card, e. using said at least one monitor to display directions to players of "No More Bets", f. using said computer to display a visual representation on said at least one monitor of the number and color combination contained on the drawn card in the form of an animated three dimensional image of a roulette wheel and a ball landing in a pocket of the roulette wheel as dictated by the number and color combination contained on the drawn card, and g. replacing the drawn card in the deck of cards.

13. A method according to claim 12 further comprising:

repeating steps a-g to play a roulette game where steps a-g substitute for a spin of a roulette wheel in a traditional roulette game.

14. A method of simulating a traditional roulette game experience using a specially designed deck of playing cards to determine play rather than spinning a roulette wheel comprising the following steps:

a. displaying directions to roulette players to "Place Your Bets" on at least one monitor that is visible from a roulette table, b. displaying winning number history on said at least one monitor while players place their bets on the roulette table c. shuffling to randomly order a special deck of thirty eight cards where each card bears a unique number and color corresponding to a pocket on a traditional roulette wheel and also contains a bar code containing non transitory computer readable information corresponding to the pocket number and color combination contained on the drawn card, d. drawing a card from the deck, e. scanning the bar code on the drawn card to a computer that is connected to and controls displays on said at least one monitor, f. updating the winning number history and game play meters in the computer, g. displaying directions to players of "No More Bets" on said at least one monitor, h. displaying a visual representation of the number and color combination contained on the drawn card on said at least one monitor to substitute for a spin of a roulette wheel in a traditional roulette game, i. displaying "Game Over" message on said at least one monitor while the dealer collects lost bets and pays winning players, j. placing the drawn card back into the deck of cards.

15. A method according to claim 14 wherein the visual representation that appears on said at least one monitor in step h is an animated three dimensional image of a spinning roulette wheel and a spinning ball landing in a pocket having the number and color combination dictated by the drawn card.

16. A method according to claim 14 further comprising:

k. pushing a key on a keyboard attached to the computer to start a new game of roulette by repeating steps a-j.

* * * * *